US006299351B1

(12) United States Patent
Warr

(10) Patent No.: US 6,299,351 B1
(45) Date of Patent: Oct. 9, 2001

(54) SIDE GUSSET BAG WITH CONVENIENT CARRY HANDLE

(75) Inventor: Charles J. Warr, High Point, NC (US)

(73) Assignee: Rex International Incorporated, Thomasville, NC (US)

( * ) Notice: Subject to any disclaimer, the term of this patent is extended or adjusted under 35 U.S.C. 154(b) by 0 days.

(21) Appl. No.: 09/650,478

(22) Filed: Aug. 29, 2000

(51) Int. Cl.[7] ..... B65D 33/08
(52) U.S. Cl. ..... 383/10; 383/120
(58) Field of Search ..... 383/10, 120

(56) References Cited

U.S. PATENT DOCUMENTS

| | | | | |
|---|---|---|---|---|
| 4,867,575 | | 9/1989 | Wood . | |
| 4,890,934 | * | 1/1990 | Feaver et al. | 383/10 |
| 5,015,103 | * | 5/1991 | Mercer | 383/10 |
| 5,338,117 | | 8/1994 | Kuchsdorf et al. . | |
| 5,758,971 | * | 6/1998 | Goglio et al. | 383/10 |

FOREIGN PATENT DOCUMENTS

| | | | | |
|---|---|---|---|---|
| 2633793 | * | 2/1978 | (DE) | 383/10 |
| 1402962 | * | 8/1975 | (GB) | 383/10 |
| 2171077 | * | 8/1986 | (GB) | 383/10 |

* cited by examiner

*Primary Examiner*—Jes F. Pascua
(74) *Attorney, Agent, or Firm*—Adams, Schwartz & Evans, P.A.

(57) ABSTRACT

A bag includes front and back panels having joined first and second opposing side edges, and opposing top and bottom end edges. An end edge seal line adjacent one of the top and bottom end edges extends laterally from one side of the bag to the other for sealably closing the adjacent end edge of the bag. The opposite end edge of the bag is open for receiving contents therein and is subsequently closed to retain the contents within the bag. The improvement in the bag includes a folded in-tuck formed along one of the first and second side edges of the bag. The in-tuck cooperates with the front and back panels to define a side gusset adapted for allowing expansion of the bag when filled. The in-tuck is sealed along the end edge seal line to form a multi-ply reinforced end portion of the bag. A handle is formed with the reinforced end portion of the bag to allow convenient handling of the bag when filled.

10 Claims, 6 Drawing Sheets

SIDE GUSSET BAG WITH CONVENIENT CARRY HANDLE

TECHNICAL FIELD AND BACKGROUND OF THE INVENTION

This invention relates generally to heavy duty plastic bags, and more specifically to side gusset style bags made from single or multi-ply polyolefin materials, such as LD, HD, and LLD polyethylene and polypropylene, as well as other woven or nonwoven, synthetic or non-synthetic materials. Such bags are typically used to package materials such as fiberglass insulation, salt, potting soil, small landscaping rocks, pet food and similar heavy materials. While the invention has particular application to bags with a capacity of from 20 to 80 pounds, the principle of the invention is applicable to bags of any size. The invention includes a carry handle formed in a multi-ply end portion of the bag to permit convenient handling and carrying of the bag when filled.

Heavy duty bags of the prior art are generally difficult and awkward to carry due in part to the relatively heavy weight or bulkiness of contents stored in the bag, and due to the lack of convenient means for handling the bag. Typically, such bags have a single die-cut handle centrally located in a top end portion of the bag above a seal line separating the handle from the bag contents. When lifting the bag from the handle, the downward pulling force acting on the bag concentrates in an area of the handle causing substantial discomfort to the hand and sometimes resulting in tears along the handle and below the seal line. Once the seal line is breached, the contents of the bag are more likely to leak out or be inadvertently spilled. Handling the bag with both hands is also troublesome due to shifting of loose contents contained in the bag.

The bag of the present invention addresses these and other problems of the prior art by providing a handle formed in a multi-ply end portion of the bag, such that the bag can be conveniently handled and moved without substantial risk of tearing into the bag contents. The handle is readily formed in the bag prior to filing, and is conveniently located to facilitate carrying the bag when filled with less strain on the hands.

SUMMARY OF THE INVENTION

Therefore, it is an object of the invention to provide a side gusset style bag with a convenient carry handle formed in a multi-ply end portion of the bag.

It is another object of the invention to provide a side gusset style bag which is conveniently carried with relatively little strain on the hands.

It is another object of the invention to provide a side gusset style bag which resists tearing at the handle when carried.

It is another object of the invention to provide a side gusset style bag which can be readily carried using both hands.

It is another object of the invention to provide a method of forming a side gusset style bag which includes a convenient carry handle.

These and other objects of the present invention are achieved in the preferred embodiments disclosed below by providing a bag including front and back panels having joined first and second opposing side edges, and opposing top and bottom end edges. An end edge seal line adjacent one of the top and bottom end edges extends laterally from one side of the bag to the other for sealably closing the adjacent end edge of the bag. The opposite end edge of the bag is open for receiving contents therein and is subsequently closed to retain the contents within the bag. The improvement in the bag includes a folded in-tuck formed along one of the first and second side edges of the bag. The in-tuck cooperates with the front and back panels to define a side gusset adapted for allowing expansion of the bag when filled. The in-tuck is sealed along the end edge seal line to form a multi-ply reinforced end portion of the bag. A handle is formed with the reinforced end portion of the bag to allow convenient handling of the bag when filled.

According to another preferred embodiment of the invention, an opposing second in-tuck is formed along the other of the first and second side edges of the bag. The second in-tuck cooperates with the front and back panels to define an opposing second side gusset adapted for allowing expansion of the bag when filled. The second in-tuck is sealed along the end edge seal line to form an opposing second multi-ply reinforced end portion of the bag.

According to another preferred embodiment of the invention, a second handle is formed with the second reinforced end portion of the bag to allow convenient handling of the bag when filled.

According to another preferred embodiment of the invention, the handle includes a generally L-shaped die-cut having a relatively straight vertical segment extending perpendicularly outward from the end edge seal line, and a lateral end segment. The die-cut is formed through the front and back panels of the bag and through the in-tuck such that the front and back panels cooperate when the bag is filled to form a generally C-shaped hand-receiving slit.

According to another preferred embodiment of the invention, the handle includes a generally C-shaped die-cut formed through the front and back panels of the bag, and through the in-tuck.

According to another preferred embodiment of the invention, the die-cut defines a relatively straight center segment extending generally parallel to the end edge seal line and opposing first and second arcuate end segments defining respective tear-resistant curved ends of the handle.

According to another preferred embodiment of the invention, the front and back panels of the bag are integrally formed together of a polyolefin sheet.

According to another preferred embodiment of the invention, the thickness of the polyolefin sheet is in the range of 3 and 12 mils or any mil thickness sufficient to contain the filled product.

According to another preferred embodiment of the invention, the polyolefin sheet is formed of a polyolefin selected from the group consisting of polyethylene and polypropylene.

In another embodiment, the invention is a method of constructing a bag. The method includes the steps of providing first and second panels having joined first and second opposed side edges, and top and bottom end edges. At least one seal line is formed adjacent one of the top and bottom end edges and extending laterally from one side edge of the bag to the other for sealably closing the adjacent end edge of the bag. The opposite end edge of the bag is open for receiving contents therein and subsequently closed to retain the contents within the bag. An in-tuck is formed along at least one of the first and second side edges of the bag. The in-tuck cooperates with the front and back panels to define a side gusset adapted for allowing expansion of the bag when filled. The in-tuck is sealed along the end edge seal line to form a multi-ply reinforced end portion of the bag. A handle is formed with the reinforced end portion of the bag to allow convenient handling of the bag when filled.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
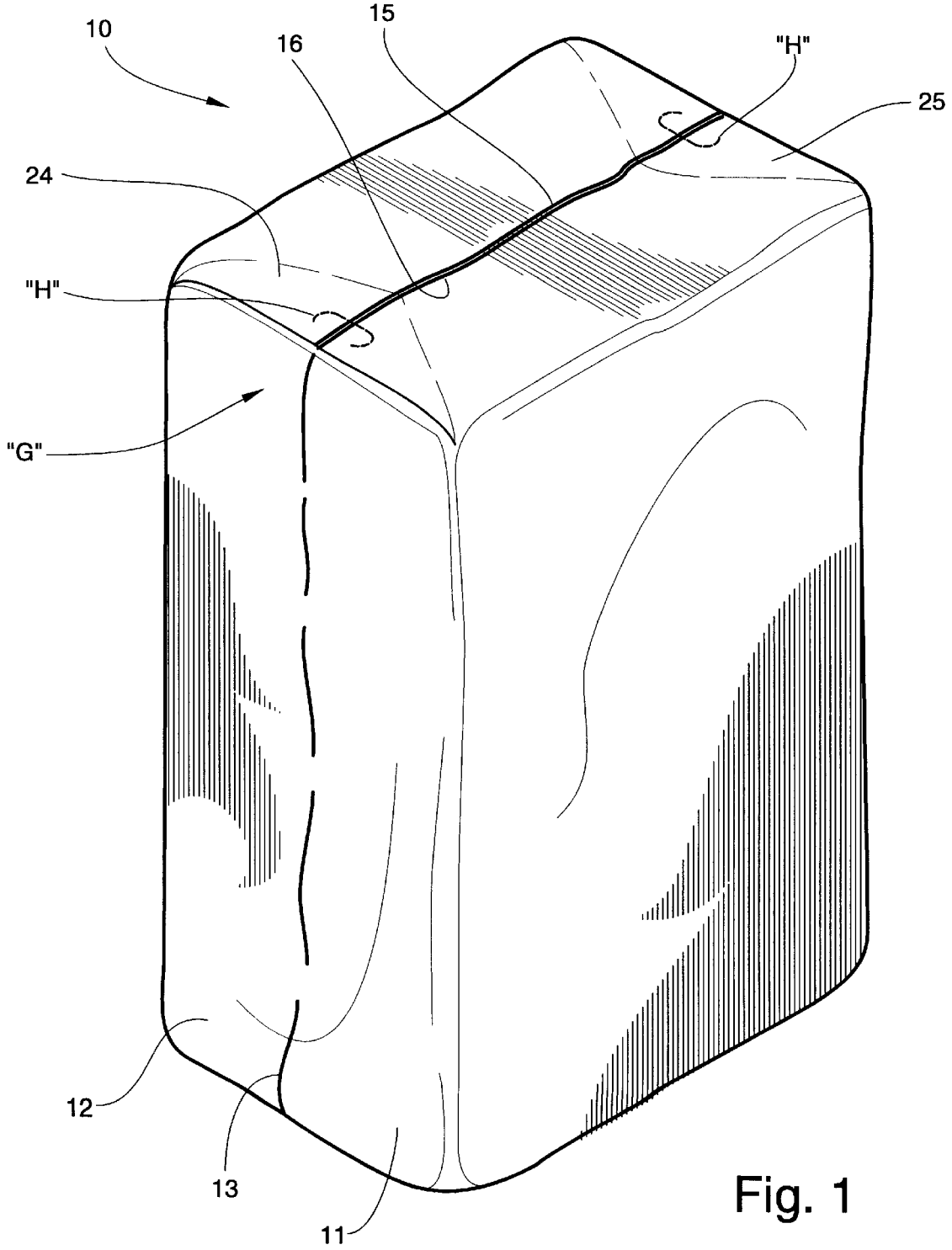
FIG. 1 is a perspective view of a side gusset style bag according to one preferred embodiment of the invention, and showing the bag filled with contents.
Figure 2:
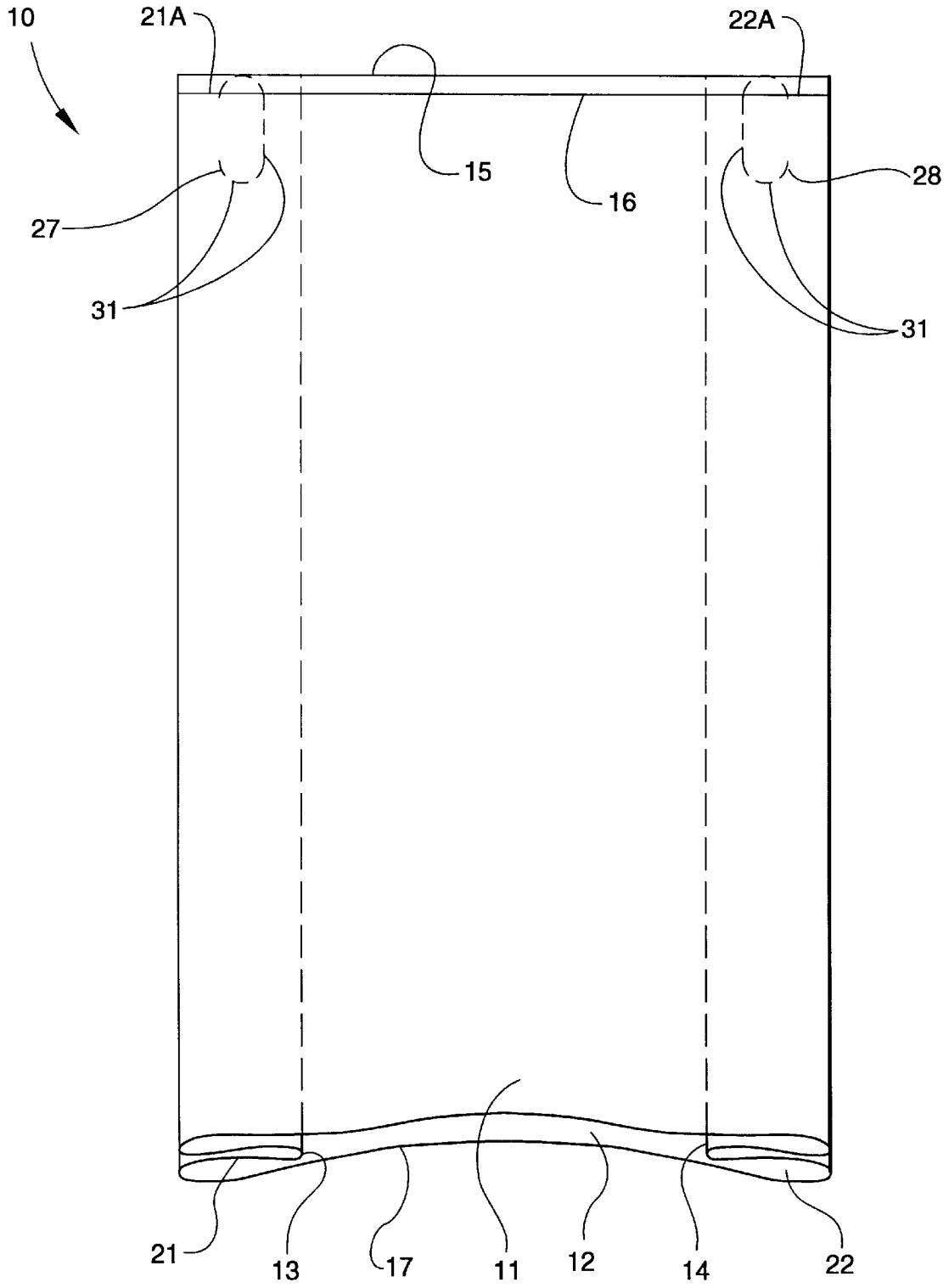
FIG. 2 is a perspective view of the side-gusset style bag laid substantially flat with one end open prior to filling with contents.

Referring now specifically to the drawings, a side gusset bag according to the present invention is illustrated in FIGS. 1 and 2 and shown generally at reference numeral 10. Bags of the type disclosed are used for heavy-duty applications, such as for transport, sale, and storage of materials such as fiberglass insulation, salt, fertilizer, lawn lime, potting soil, and the like. The bags are typically fabricated from a polyolefin sheet or tube stock such as polyethylene or polypropylene having a thickness in the range of 3 to 12 mils. The sheet or tube stock may be coextruded or monoextruded, and may be single ply or multi-ply material. The multi-ply material may be multiple thicknesses of the same sheet or tube stock, or different materials to provide particular characteristics, such as strength, flexibility, UV resistance, or color. The sheet stock may also be woven or non-woven synthetic or non-synthetic material.

Bag 10 is formed from thermoplastic sheet or tube stock, and has overlying front and back panels 11 and 12, defining opposing joined side edges 13 and 14. The term "joined" is used in a broad sense to mean either two formerly separate sheets connected together, or integrally formed by, for example, folding over a sheet to define an edge. For purposes of example and illustration, bag 10 is a side gusset, tube-type bag. However, bags incorporating the invention of this application may be fabricated in a side gusset back seam style or in any other suitable gusset design. Preferably, the end edge 15 of the bag 10 is closed by a lateral end edge seal line 16 formed by adhesive, sewing, ultrasonic heating, or other heat-fusing process connecting the thermoplastic panels 11 and 12 together along a narrow, straight line to form a closed end of the bag 10, as shown. The opposite end edge 17 of the bag 10 remains open for filling, as shown in FIG. 2.

First and second opposing, folded in-tucks 21 and 22 are formed along respective sides edges 13 and 14 of the bag 10. The in-tucks 21, 22 cooperate with the joined front and back panels 11 and 12 to define respective, opposing side gussets "G" adapted for allowing expansion of the bag 10 when filled, as shown in FIG. 1. One end edge 21A, 22A of each in-tuck 21, 22 is sealed along the lateral end edge seal line 16 together with the front and back panels 11 and 12 to form opposing, multi-ply, reinforced end portions 24 and 25 of the bag 10. Once filled, the open end edge 17 of the bag 10 is closed to contain the contents inside the bag.

Figure 3:
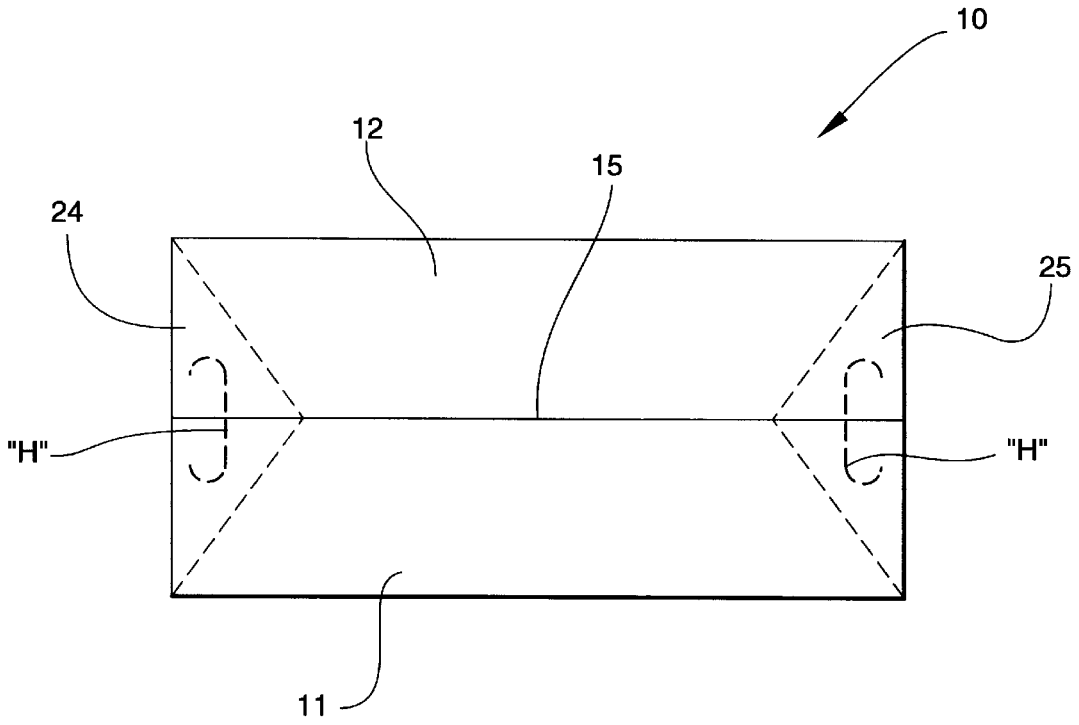
FIG. 3 is a plan view showing the handle end of the bag when filled.
Figure 4:
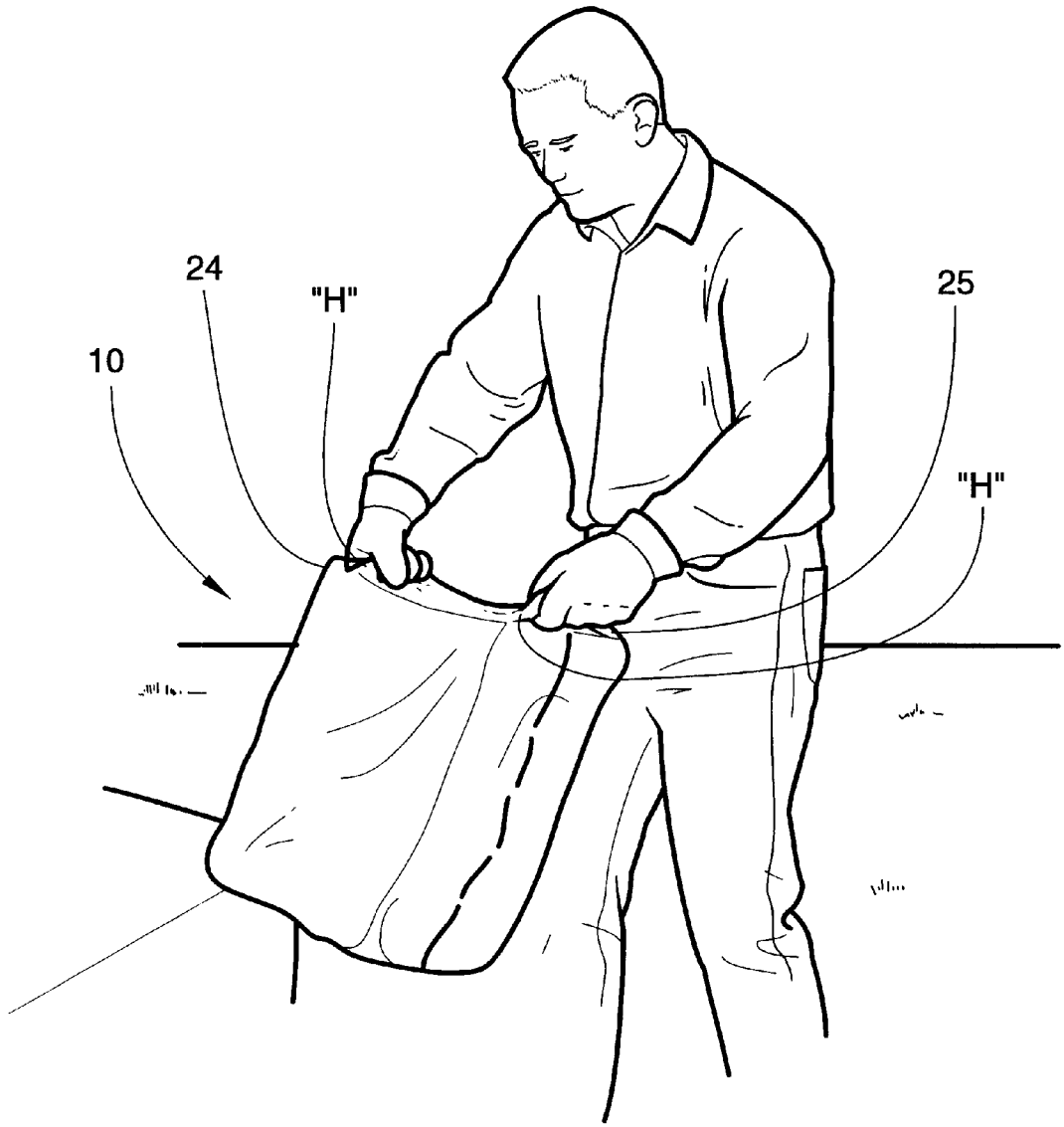
FIG. 4 is an environmental perspective view of the bag being carried by the handles.

First and second generally L-shaped slits 27 and 28 are die-cut into the reinforced end portions 24 and 25 of the bag 10 with the bag laid in a flat condition, as shown in FIG. 2, prior to filling. Each slit 27, 28 has a relatively straight vertical segment extending perpendicularly downward from the closed end edge 15 of the bag, and a lateral end segment which curves around in an arcuate shape away from an adjacent, in-tucked side edge 13, 14 of the bag 10. The die-cuts extend through each of the front and back panels 11, 12 and through the in-tucks 21, 22, such that when the bag 10 is filled, as shown in FIGS. 1, 3, and 4, the cuts made through the front and back panels 11 and 12 cooperate to form a generally C-shaped handle "H" adapted for receiving the hand for convenient carrying and handling of the bag 10. The curved lateral end segment defines opposing arcuate ends of the handle shaped to resist tearing from the top of the bag 10 when the handle is in use. Preferably, a number of tear-away lands 31 are formed along each slit 27, 28 to seal the die-cut handle prior to use. Because the die-cuts are formed in the multi-ply, end portions 24, 25 of the bag 10, the bag resists leakage and inadvertent tearing in the area of the handles.

FIG. 4 demonstrates one preferred technique for carrying the bag 10 using the handles "H". Because the handles "H" are laterally spaced-apart on opposite end portions 24 and 25 of the bag 10, an individual is able to lift the bag using both hands with the weight of the bag 10 more evenly distributed, thereby facilitating carrying and handling of the bag 10.

Figure 7:
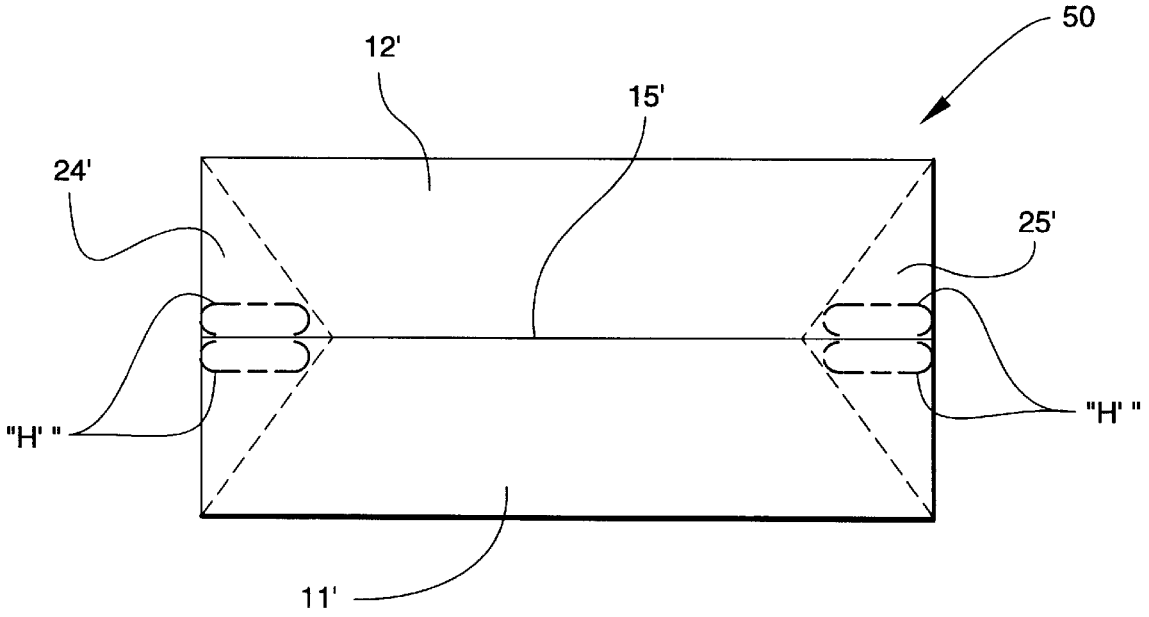
FIG. 7 is a plan view of the bag illustrated in FIGS. 5 and 6, and showing the handle end of the bag when filled.
Figure 5:
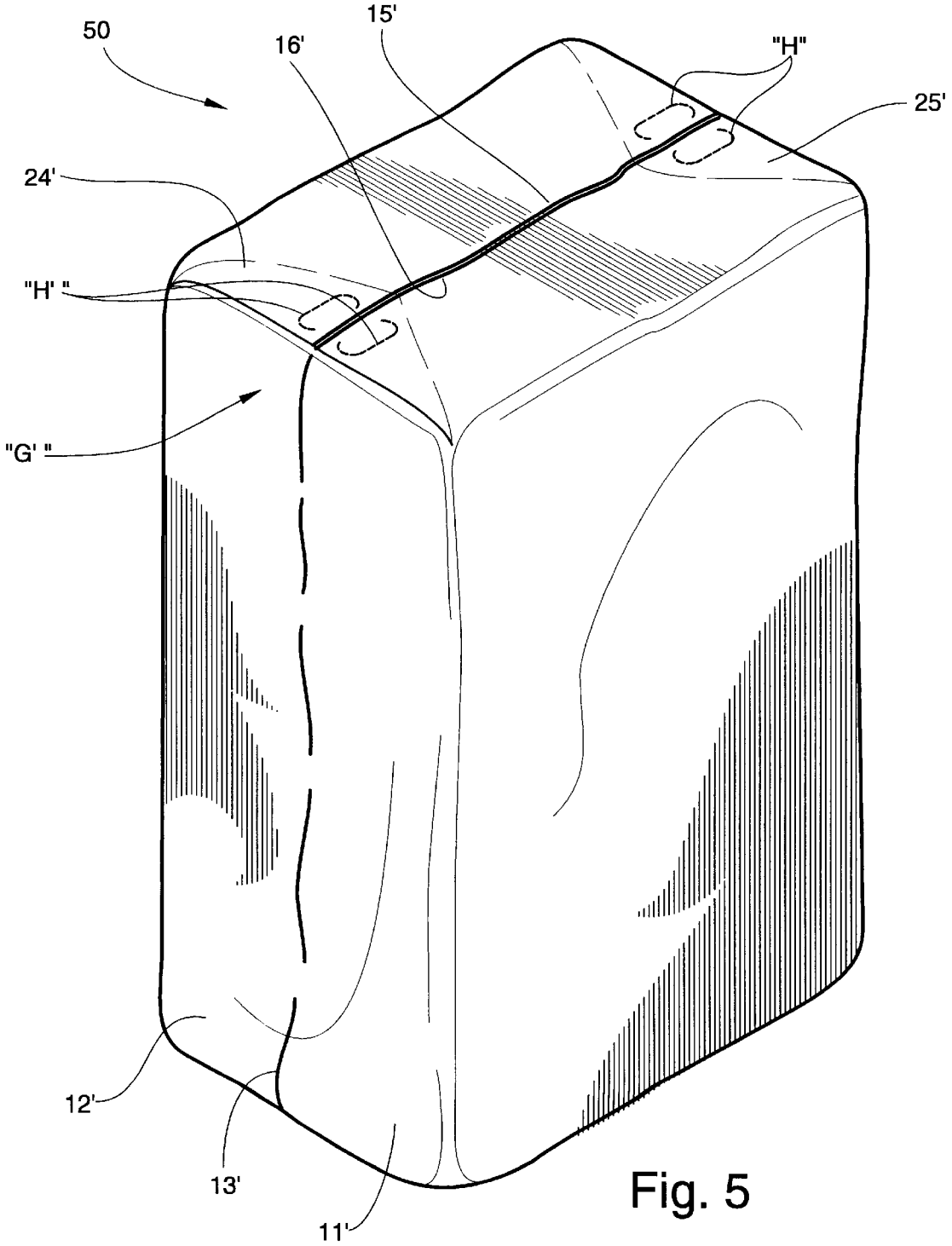
FIG. 5 is a perspective view of a side gusset style bag according to a second preferred embodiment of the invention, and showing the bag filled with contents.
Figure 6:
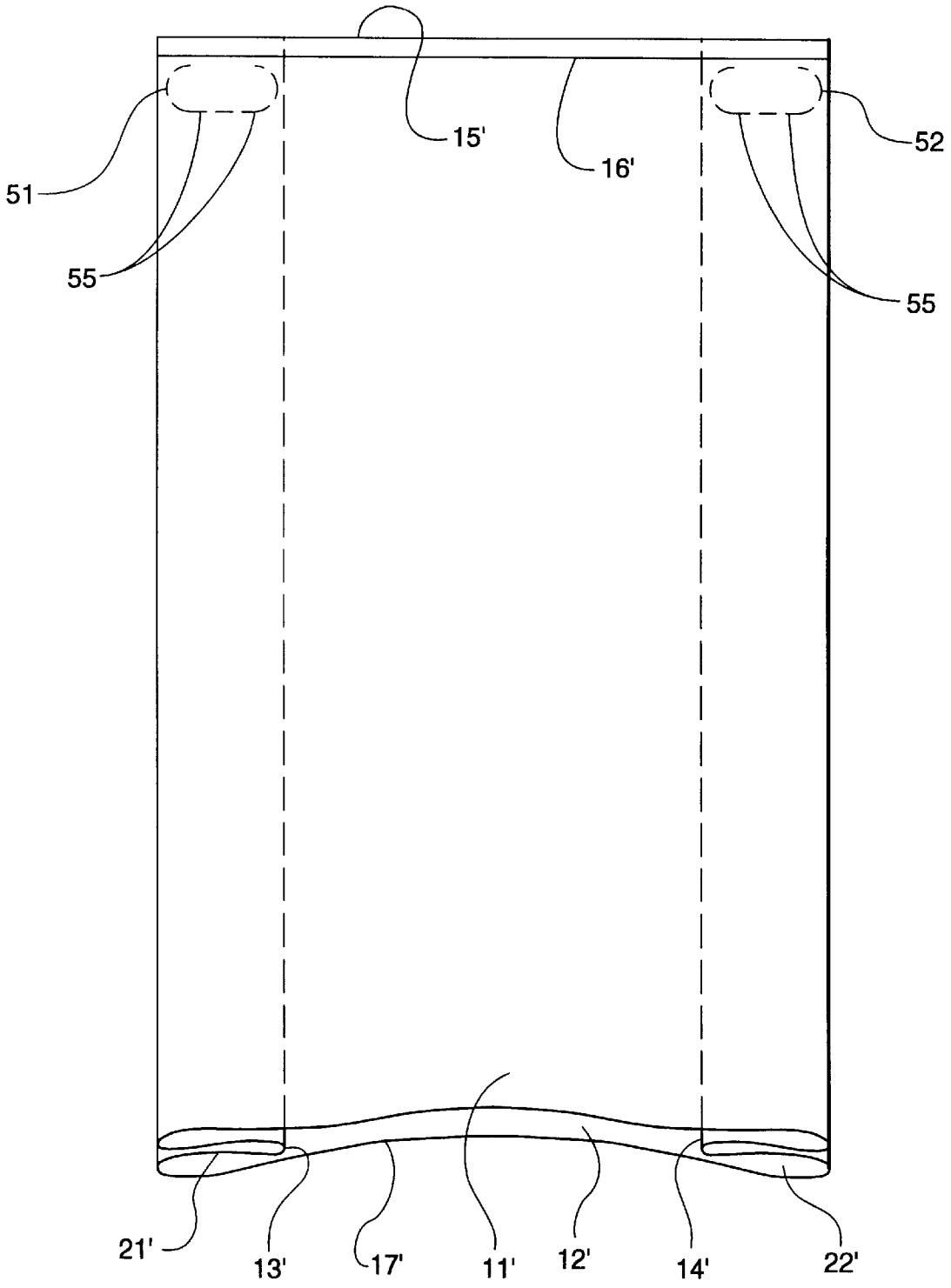
FIG. 6 is a perspective view of the side-gusset style bag illustrated in FIG. 5 with the bag laid substantially flat with one end open prior to filling with contents.

A further preferred embodiment of the invention is illustrated in FIGS. 5–7. Like elements corresponding to the bag 10 are indicated in prime notation. The bag 50 has front and back panels 11' and 12' joined together along opposing side edges 13' and 14', and folded in-tucks 21' and 22' which cooperate with the joined front and back panels 11' and 12' to define respective, opposing side gussets "G'" adapted for allowing expansion of the bag 50 when filled, as best shown in FIG. 5. The end edge 15' of the bag 50 is closed by a lateral end edge seal line 16' while the opposite end edge 17' of the bag 50 remains opens for filling.

In the bag 50, first and second generally C-shaped slits 51 and 52, shown in FIG. 6, are die-cut into the reinforced end portions 24' and 25' with the bag laid in a flat condition. Each slit 51, 52 has a relatively straight center segment extending generally parallel to the end edge seal line 16', and opposing first and second arcuateend segments curving upwardly towards the closed end edge 17' of the bag 50. When the bag 50 is filled, as shown in FIGS. 5 and 7, the die-cuts form respective opposing pairs of handles "H" adapted for allowing convenient carrying and handling of the bag 50. The ends of each handle "H'" are shaped to resist tearing from the top of the bag 50 when the handle is in use. Preferably, a number of tear-away lands 55 are formed along each slit 51, 52 to seal the die-cut handle prior to use.

A side gusset bag with a convenient carry handle is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a bag comprising front and back panels joined together to define a contents-receiving cavity, said panels having first and second opposing side edges, opposing top and bottom end edges, and an end edge seal line adjacent one of the top and bottom end edges and extending laterally from one side of the bag to the other for sealably closing the adjacent end edges of the bag, the opposite end edge of the bag being open for receiving contents therein and subsequently closed to retain the contents within the bag, the improvement comprising:

(a) a folded in-tuck formed along one of the first and second side edges of said bag and cooperating with the front and back panels to define a side gusset adapted for allowing expansion of said bag when filled, said in-tuck being sealed along the end edge seal line to form a multi-ply reinforced end portion of said bag; and (b) a die-cut handle formed in the reinforced end portion of said bag and defining a handle slit communicating with the contents-receiving cavity of said bag, said handle allowing convenient handling of said bag when filled.

2. A bag according to claim 1, and comprising an opposing second in-tuck formed along the other of said first and second side edges of said bag and cooperating with the front and back panels to define an opposing second side gusset adapted for allowing expansion of said bag when filled, said second in-tuck being sealed along the end edge seal line to form an opposing second multi-ply reinforced end portion of said bag.

3. A bag according to claim 2, and comprising a second handle formed with the second reinforced end portion of said bag to allow convenient handling of said bag when filled.

4. A bag according to claim 1, wherein said handle comprises a generally L-shaped die-cut having a relatively straight vertical segment extending perpendicularly outward from said end edge seal line, and a lateral end segment, said die-cut being formed through said front and back panels of said bag and through said in-tuck such that said front and back panels cooperate when said bag is filled to form a generally C-shaped hand-receiving slit.

5. A bag according to claim 1, wherein said handle comprises a generally C-shaped die-cut formed through said front and back panels of said bag, and through said in-tuck.

6. A bag according to claim 5, wherein said die-cut defines a relatively straight center segment extending generally parallel to said end edge seal line and opposing first and second arcuate end segments defining respective curved ends of said handle.

7. A bag according to claim 1, wherein said front and back panels are integrally formed together of a polyolefin sheet.

8. A bag according to claim 7, wherein the thickness of said polyolefin sheet is in the range of 3 and 12 mils.

9. A bag according to claim 7, wherein said polyolefin sheet is formed of a polyolefin selected from the group consisting of polyethylene and polypropylene.

10. A method of constructing a bag, comprising the steps of:

(a) providing first and second panels joined together to define a contents-receiving cavity, said panels having first and second opposed side edges, and top and bottom end edges;

(b) forming at least one seal line adjacent one of the top and bottom end edges and extending laterally from one side edge of the bag to the other for sealably closing the adjacent end edge of the bag, the opposite end edge of the bag being open for receiving contents therein and subsequently closed to retain the contents within the bag;

(c) forming an in-tuck along at least one of the first and second side edges of the bag, the in-tuck cooperating with the front and back panels to define a side gusset adapted for allowing expansion of the bag when filled, the in-tuck being sealed along the end edge seal line to form a multi-ply reinforced end portion of the bag; and (d) forming a die-cut handle in the reinforced end portion of the bag and defining a handle slit communicating with the contents-receiving cavity of said bag, said handle allowing convenient handling of the bag when filled.

* * * * *

UNITED STATES PATENT AND TRADEMARK OFFICE

CERTIFICATE OF CORRECTION

PATENT NO. : 6,299,351 B1
DATED : October 9, 2001
INVENTOR(S) : Warr, Charles J.

It is certified that error appears in the above-identified patent and that said Letters Patent is hereby corrected as shown below:

Column 5,
Line 11, the word "edges" should be changed to -- edge --.

Signed and Sealed this

Thirtieth Day of April, 2002

*Attest:*

*Attesting Officer*

JAMES E. ROGAN
*Director of the United States Patent and Trademark Office*